US008997352B2

(12) United States Patent
Troeger et al.

(10) Patent No.: US 8,997,352 B2
(45) Date of Patent: Apr. 7, 2015

(54) METHOD FOR MANUFACTURING EXHAUST GAS DUCTING DEVICE

(75) Inventors: Uwe Troeger, Langweid (DE); Manfred Stiglmair, Thierhaupten (DE)

(73) Assignee: Faurecia Emissions Control Technologies, Germany GmbH, Augsburg (DE)

( * ) Notice: Subject to any disclaimer, the term of this patent is extended or adjusted under 35 U.S.C. 154(b) by 197 days.

(21) Appl. No.: 13/522,171

(22) PCT Filed: Jun. 30, 2010

(86) PCT No.: PCT/EP2010/003959

§ 371 (c)(1),
(2), (4) Date: Jul. 13, 2012

(87) PCT Pub. No.: WO2011/088852

PCT Pub. Date: Jul. 28, 2011

(65) Prior Publication Data

US 2012/0279046 A1 Nov. 8, 2012

(30) Foreign Application Priority Data

Jan. 25, 2010 (DE) ..... 10 2010 005 629

(51) Int. Cl.

| | |
|---|---|
| ***B21D 51/16*** | (2006.01) |
| ***F01N 13/18*** | (2010.01) |
| ***F01N 3/28*** | (2006.01) |

(52) U.S. Cl.

CPC ..... *F01N 13/18* (2013.01); *F01N 3/2853* (2013.01); *F01N 2330/06* (2013.01); *F01N 2350/02* (2013.01); *F01N 2450/02* (2013.01)

(58) Field of Classification Search

CPC ... F01N 3/2853; F01N 2450/02; F01N 13/18; F01N 2350/04; B01J 35/04; B23P 19/04; B23P 19/10; B21D 41/04

USPC ..... 29/890, 890.08, 407.1, 407.04, 407.08, 29/407.05; 72/121

See application file for complete search history.

(56) References Cited

U.S. PATENT DOCUMENTS 6,769,281 B2 * 8/2004 Irie et al. ..... 72/121
2006/0150382 A1 7/2006 Martin (Continued)

FOREIGN PATENT DOCUMENTS

EP 1344911 A1 9/2003
EP 1445443 A1 2/2004

(Continued)

OTHER PUBLICATIONS

International Search Report and Written Opinion dated Nov. 5, 2010.

*Primary Examiner* — David Bryant
*Assistant Examiner* — Jun Yoo
(74) *Attorney, Agent, or Firm* — Carlson, Gaskey & Olds

(57) ABSTRACT

A method for manufacturing exhaust gas ducting devices provides each device with an outer housing having an insert clamped therein, wherein the insert comprises a substrate traversed by exhaust gas, and an elastic compensating element surrounding the substrate. The method includes spreading each individual compensating element on a base and deforming the compensating element substantially vertical to the base by exerting a pressure such that the entire compensating element is subjected to a full-surface load. Then a setpoint deformation of the compensating element is determined, which is necessary to achieve a specified setpoint pressure. The method further includes determining at least one parameter of the substrate individually, placing the compensating element around the substrate, and mounting the insert thus obtained in an outer housing having inside dimensions that correspond to outside dimensions of the insert with the determined setpoint deformation.

22 Claims, 4 Drawing Sheets

(56) References Cited

U.S. PATENT DOCUMENTS

| | | | | |
|---|---|---|---|---|
| 2006/0272153 | A1 | 12/2006 | Bowman | |
| 2008/0201949 | A1 * | 8/2008 | Kroner | 29/890.08 |
| 2008/0263866 | A1 | 10/2008 | Mayfield | |
| 2010/0275443 | A1 * | 11/2010 | Kroner et al. | 29/890 |
| 2011/0171079 | A1 | 7/2011 | Garcia Gomez | |

FOREIGN PATENT DOCUMENTS

| | | | |
|---|---|---|---|
| WO | 2006076469 | A2 | 7/2006 |
| WO | 20070115623 | A1 | 10/2007 |

* cited by examiner

METHOD FOR MANUFACTURING EXHAUST GAS DUCTING DEVICE

CROSS-REFERENCE TO RELATED APPLICATION

This application is the United States national phase of PCT/EP2010/003959 filed Jun. 30, 2010, claiming priority to DE 10 2010 005 629.4.

TECHNICAL FIELD

This invention relates to a method for manufacturing exhaust gas ducting devices, in particular exhaust gas cleaning devices, which each have an outer housing with an insert clamped therein, wherein the insert comprises a substrate traversed by exhaust gas and an elastic compensating element surrounding the substrate.

BACKGROUND OF THE INVENTION

The exhaust gas ducting devices in accordance with the invention are e.g. mufflers, but in particular exhaust gas cleaning devices such as catalysts and particle filters.

Such can include devices inserts which are very sensitive to radial pressure. So far, these are mainly axially traversed ceramic substrates, which are wrapped with an elastic compensating element (for example in the form of a mat). If possible, these inserts are held in the outer housing in an axial and radial direction only by radial clamping. On the one hand, the clamping force must be so great that in driving operation no axial relative displacement is obtained between insert and outer housing due to the gas pressure or due to vibrations. On the other hand, the radial pressure should of course not be so great that it leads to a destruction of the insert, in particular a destruction of the pressure-sensitive catalyst or particle filter substrate. Attempts are being made now to use inserts of low weight, which heat up faster in driving operation. Such substrates for example comprise a corrugated-board-like supporting structure which is coated with catalyst material.

Mounting and clamping the insert in the outer housing is typically effected either by wrapping a sheet metal jacket around the insert, by pushing the insert into a tube, which depending on the method can be pre- and/or post-calibrated, or by closing shells. When the force applied is too great, destruction of the insert, i.e. of the substrate in the case of catalysts or particle filters, can occur.

When manufacturing exhaust gas cleaning devices a great difficulty consists in that between the substrate and the outer housing the elastic compensating element, typically the bearing mat, is provided, which ensures a pressure compensation and a constant pretension. The disadvantage of this bearing mat, however, consists in that after being compressed it is subjected to a certain settling process, referred to as relaxation, so that the pressure passed on by the same to the substrate decreases. Rebound of the outer housing after mounting and clamping likewise leads to the fact that the pressure initially applied onto the substrate, and hence the clamping force applied, decreases. Furthermore, the holding pressure of the bearing mat decreases in operation (for example due to ageing). This leads to the fact that with regard to the future safe clamping of the substrate in the outer housing even more initial pressure is exerted by the outer housing onto the insert by way of precaution and individual substrates approach the limits of stability.

To ensure a sufficiently safe clamping in the outer housing and minimum scrap rates even in the case of very pressure-sensitive inserts, it is proposed in DE 10 2006 015 657 A1 to individually load small partial areas of each compensating element in a predetermined way and plot an individual deformation-pressure curve. From this curve, a setpoint deformation of the compensating element, which is necessary to achieve a setpoint pressure, is determined. In contrast to conventional methods, the individual deformation behavior of the respective compensating element thus is considered when dimensioning the outer housing, in order to obtain a desired clamping force of the insert in the outer housing as exactly as possible.

In DE 10 2006 015 657 A1 it is explicitly stated that rather small partial areas of the bearing mat (up to a maximum of 25% of the total surface) are loaded for plotting the deformation-pressure curve, in order to keep "damages" of the bearing mat, such as the breaking or alignment of fibers, as low as possible.

It was discovered, however, that these small partial areas are not always representative for the deformation behavior of the entire compensating element, which can lead to inaccuracies when determining the setpoint deformation, and correspondingly to undesirably large deviations from the specified setpoint pressure.

Moreover, it was found that loading small partial areas creates high requirements as to the test set-up and requires an extremely exact execution of the test, in order to achieve satisfactory results. However, since the deformation-pressure curve is plotted for each individual compensating element in a mass production of catalysts or particle filters, such effort is problematic for economic reasons.

There is a need to eliminate the described problems and provide a method for manufacturing exhaust gas ducting devices, in which a rather constant, specified clamping force between insert and outer housing is achieved with little effort.

SUMMARY OF THE INVENTION

A method for manufacturing exhaust gas ducting devices, in particular exhaust gas cleaning devices, provides the following for each device: an outer housing with an insert clamped therein, wherein the insert comprises a substrate traversed by exhaust gas, and an elastic compensating element surrounding the substrate. The method includes the following steps: a) each individual compensating element is spread on a base and deformed substantially vertical to the base by exerting a pressure, wherein the entire compensating element is subjected to a full-surface load; b) from the values determined, a setpoint deformation of the compensating element is determined, which is necessary to achieve a specified setpoint pressure; c) at least one parameter of the substrate is determined individually; d) the compensating element is placed around the substrate; and e) the insert thus obtained is mounted in an outer housing, whose inside dimensions correspond to the outside dimensions of the insert with the determined setpoint deformation.

In contrast to the aforementioned prior art, the compensating element, in general a bearing mat, is subjected to a full-surface load, in order to plot a deformation-pressure curve. Due to this full-surface loading, the above-mentioned problems with regard to the identification of representative partial areas are solved automatically. In addition, the load-pressure curves of compensating elements subjected to a full-surface load are relatively robust with respect to minor changes in the marginal conditions, i.e. they are much less dependent on exact, laboratory-scale test conditions. Consequently, excellent results can also be achieved with acceptable effort in a mass production.

In one embodiment, the pressure exerted in step a) is constantly increased up to a predetermined test limit.

In step a), the deformation and pressure values are preferably measured continuously and are included in a compression curve of the compensating element. As compared to measurement pairs merely recorded point by point, the constant increase in pressure and the continuous acquisition of measured values leads to distinctly more accurate results. This has an advantageous influence in particular on a possibly necessary future extrapolation of the compression curve.

In one method variant, the setpoint pressure lies in a damaging range of the compensating element and the predetermined test limit lies below the damaging range, wherein in step b) the setpoint deformation is extrapolated from the deformation when applying pressure up to the predetermined test limit. In this connection, "damaging range" is referred to as a loading zone within which the compensating element no longer shows a reversible, ideal-elastic behavior. In this region, the deformation already has a plastic component, for example due to an irreversible alignment of fibers or a breakage of fibers. Loading in the damaging range does not mean that the compensating element subsequently would be useless for use in an exhaust gas cleaning device, but merely that when loaded again the compensating element shows a changed deformation behavior, i.e. a different compression curve. However, since the predetermined load limit lies below the damaging range, it can be assumed in this case that the deformation behavior of the compensating element when plotting the compression curve substantially corresponds to the future deformation behavior during assembly in the outer housing. Accordingly, the setpoint deformation can be determined by simple extrapolation of the compression curve up to the specified setpoint pressure.

In this method variant, the setpoint deformation might however also be extrapolated in step b) from the deformation when applying pressure up to the predetermined test limit and might additionally be adapted by a correction value, wherein the correction value considers influences of the assembly in step e) on the deformation behavior of the compensating element. Between the deformation behavior when plotting the compression curve and the future built-in condition a systematic deviation exists, which is caused by the respective assembly method. The correction value eliminates or reduces this systematic error and generally is empirically determined for a concrete assembly method.

In another method variant, the setpoint pressure and the predetermined test limit lie in a damaging range of the compensating element, wherein in step b) the setpoint deformation is interpolated or extrapolated from the deformation when applying pressure up to the predetermined test limit and additionally is adapted by a correction value, wherein the correction value considers a damage of the compensating element during the application of pressure up to the predetermined test limit. Due to this increase of the predetermined test limit up into the damaging range of the compensating element, the inaccuracy or the error during extrapolation of the compression curve is distinctly reduced. In this case, however, the setpoint deformation obtained also is adapted by a correction value, which considers the "damage" (e.g. due to fiber breakage or irreversible alignment of the fibers) during the application of pressure up to the predetermined test limit. In general, this correction value is determined empirically for a particular group of compensating elements (same geometry, same material, same structure), so that their compression curve during the future assembly in the outer housing can be predicted very precisely.

In this method variant, the predetermined test limit can even lie above the specified setpoint pressure. The setpoint deformation of the compensating element in step b) then can be determined by interpolation, which as compared to extrapolation provides for a more precise determination of the setpoint deformation to achieve the specified setpoint pressure.

In this method variant, the setpoint deformation preferably is adapted by a further correction value, which additionally considers influences of the assembly in step e) on the deformation behavior of the compensating element. As already mentioned above, a systematic error in the determination of the deformation behavior in the outer housing, which is dependent on the assembly method, thereby is eliminated or at least reduced.

A lower limit of the damaging range can lie at about 33% of the setpoint pressure. The 33% merely represents a rough guide value for the lower limit of the damaging range, but has turned out to be a correct order of magnitude in particular when the setpoint pressure is chosen close to the fracture limit of currently used substrates, i.e. for example at about 90-95% of the fracture limit of the substrate.

To further optimize the future clamping of the insert in the outer housing, further parameters can be considered during or after the interpolation or extrapolation. Reference should be made here in particular to the rebound of the outer housing after the closing operation, which occurs, e.g. in wrapped housings, or the expansion of the housing (in the case of a prefabricated cylindrical outer housing into which the insert is pushed), which occurs after the assembly. Furthermore, the change in shape of the outer housing, which occurs in the case of changes in temperature (inevitable in operation of the exhaust gas cleaning device), advantageously should be considered; especially housings with a non-round cross-section tend to "become round". If this tendency is already taken into account when determining the individually tailor-made outer housing for the respective insert, in that for example an oval housing is made slightly more oblong, local pressure peaks in the regions with a smaller radius can be avoided. In this way, a smaller substrate load is obtained, which results in less scrap and a better durability.

In accordance with a preferred method variant, the individual outer geometry of the substrate is determined in addition to the determination of the setpoint deformation of the compensating element, which likewise is included in the calculation of the housing geometry.

For this purpose, the substrate is measured for example, which can be effected by using a camera, by laser measurement, or mechanically.

The exhaust gas ducting device, which is manufactured by the method of the invention, preferably contains a ceramic substrate and in particular is an exhaust gas catalyst or a particle filter, which are both provided with a labile substrate as a core of the insert. A combination of catalyst and particle filter also is possible.

The outer housing in particular can be a sheet metal housing. Furthermore, the compensating element is preferably a bearing mat.

The method of the invention can be applied to any assembly method known so far in the manufacture of exhaust gas ducting devices.

A first method is the so-called "wrapping," in which a plate-shaped sheet metal portion of the outer housing is wrapped around the insert and subsequently is attached to its edges and closed when the predetermined inside dimensions are reached.

A second method is referred to as "calibrating," in which pressure is applied from the outside against the circumference of the prefabricated tube, in order to plastically deform the same and press the same against the insert.

A third method provides an outer housing comprising a plurality of shells, which are pressed against the insert and subsequently attached to each other.

A fourth embodiment provides a so-called "stuffing" method. Here, a plurality of cylindrical outer housings with different inside dimensions are prefabricated. As described above, those inside dimensions of the outer housing are determined by the method of the invention which ensure the desired clamping. Subsequently, the outer housing with the corresponding dimensions can then be used to push the insert into the end face of the outer housing. Alternatively, the outer housing can also be fabricated especially with the optimum inside dimensions determined during the pressure and path measurement and during the subsequent calculation.

Another advantage obtained with the full-surface loading of the compensating element and the values plotted thereby consists in that the values can be used in the sense of a 100% incoming goods inspection or quality control. When the plotted values lie outside predefined tolerance ranges, the corresponding compensating element is recognized as scrap, so that only compensating elements free from defects are used.

BRIEF DESCRIPTION OF THE DRAWINGS

Further features and advantages of the invention can be taken from the following description and from the attached drawings to which reference is made, and in which.

DETAILED DESCRIPTION

Figure 1:
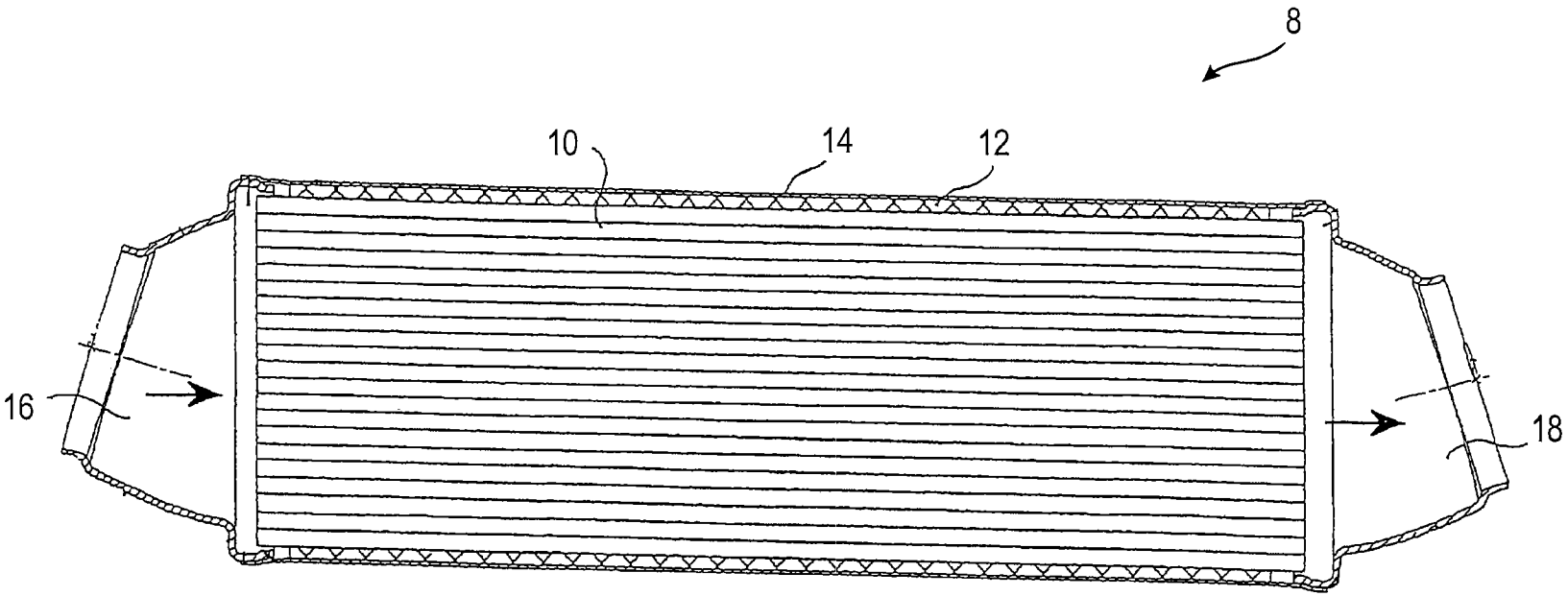
FIG. 1 shows a longitudinal section through an exhaust gas cleaning device manufactured in accordance with the invention.

FIG. 1 shows an exhaust gas ducting device 8 accommodated in a motor vehicle in the form of an exhaust gas cleaning device. The exhaust gas cleaning device either is an exhaust gas catalyst, a particle filter, or a combination thereof.

The centerpiece of the exhaust gas cleaning device is an elongate, cylindrical substrate 10, which for example comprises a ceramic or metallic substrate, a kind of wound corrugated board, or some other catalytic carrier or filter material with or without coating. The substrate 10 can have a circular-cylindrical cross-section or a non-round cross-section. For simplified representation only, a circular-cylindrical cross-section is shown in the Figures. The substrate 10 is surrounded by a bearing mat which acts as an elastic compensating element 12 between the substrate 10 and an outer housing 14. The outer housing is constructed to be very thin-walled and, in particular, of sheet metal. Upstream and downstream, an inflow funnel 16 and an outflow funnel 18, respectively, are connected with the outer housing 14.

Together with the compensating element 12 the substrate 10 forms a unit which subsequently is also referred to as an insert.

In operation, exhaust gas flows through the inflow funnel 16 on an end face into the substrate 10 and finally leaves the substrate 10 with less noxious substances on an opposite end face, in order to leave the exhaust gas ducting device 8 via the outflow funnel 18.

The manufacture of the exhaust gas cleaning device will be explained in detail below with reference to FIGS. 2 to 5.

Figure 2:
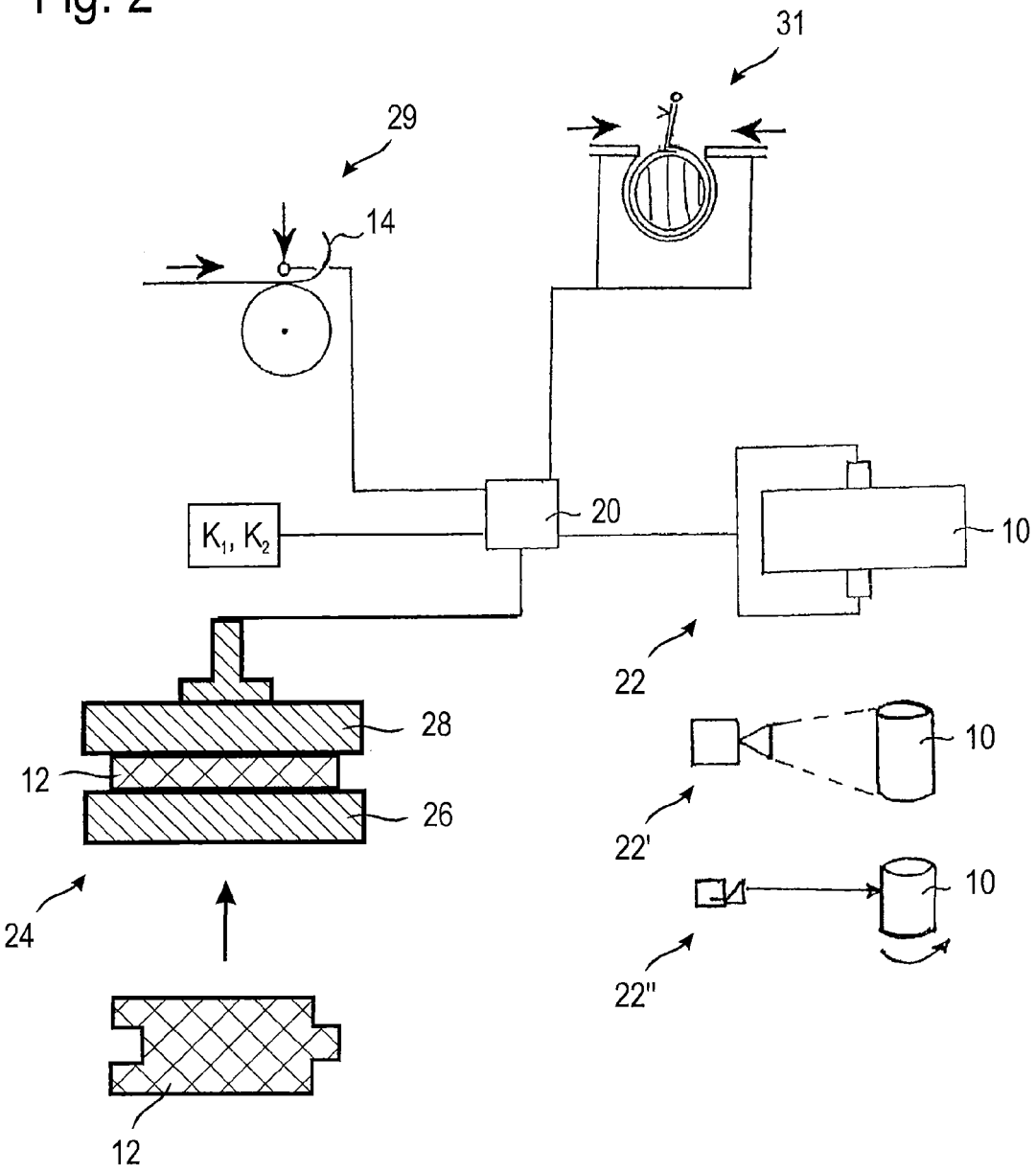
FIG. 2 shows a schematic diagram of measuring devices and tools which are used in the method in accordance with the invention.

In FIG. 2, various measurement stations are shown, by which properties of each individual substrate 10 and each bearing mat are determined with regard to an individually adjusted outer housing 14 to achieve an optimized clamping force of the insert in the outer housing 14. Via a controller 20, the measurement stations are coupled with tools for manufacturing the outer housing 14 and for mounting and clamping the insert in the outer housing 14. The stations explained below will be described in the preferred order of the manufacturing method.

In a measuring device 22 a parameter of the substrate 10 is determined individually. According to FIG. 2, this parameter is the outside geometry (shape and outside dimensions, in particular circumference) of the substrate 10, which preferably is determined by using contactless measurement sensors. The measuring device 22 is connected with the controller 20 in which the measured values obtained for the substrate 10 are stored. Alternatively, a charge coupled device (CCD) camera 22' or a laser measuring device 22" can also be employed for determining the outside geometry.

In a tension-pressure testing machine 24 each individual compensating element 12, i.e. each bearing mat, is placed flat onto a flat base 26 and deformed by exerting a pressure p substantially vertical to the base 26, wherein the entire bearing mat is subjected to a full-surface load.

Figure 3:
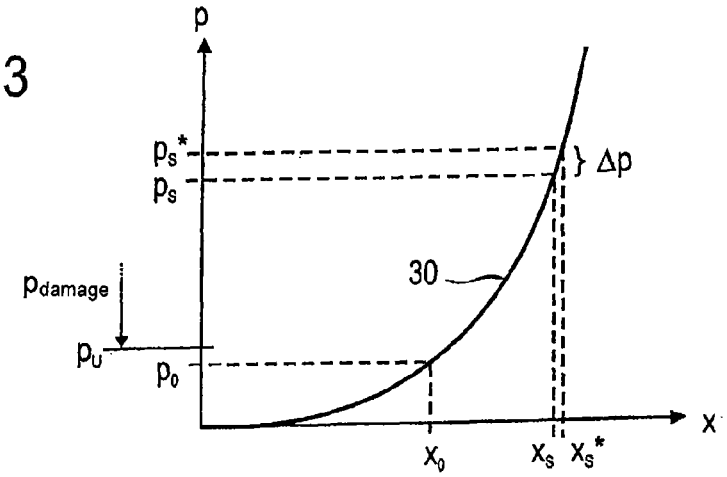
FIG. 3 shows a path-pressure diagram characteristic for the method of the invention during the deformation of the compensating elements.

As shown in FIG. 3, the pressure p applied onto the bearing mat is constantly increased up to a predetermined test limit $p_0$. For increasing the pressure p, a punch 28 is moved in the direction towards the base 26, wherein both the pressure p and the travel x of the punch 28 are plotted. The travel x is defined as zero in the case of contact with the compensating element 12, so that it corresponds to a deformation of the compensating element 12. As an alternative to the travel x, the distance between the base 26 and the punch 28 can also be detected.

The pressure and deformation values p, x of the compensating element 12 are measured continuously and included in a compression curve 30 (cf. FIG. 3). Instead of such continuous measurement a merely point-by-point measurement of certain pairs of values is of course also conceivable.

FIG. 3 schematically shows the course of the pressure p exerted on the bearing mat in dependence on the (actual or calculated) travel x. As mentioned already, the testing pressure $p_0$ is exerted on the bearing mat by the punch 28, which corresponds to a travel $x_0$ of the punch 28. The value $p_0$ initially is defined in dependence on the materials used for the insert and is constant for all components of one series. During the movement of the punch 28, a plurality of measured values for the pressure p are transmitted to the controller 20 in dependence on the travel x. From these measured values specific for each bearing mat, the further course of the compression curve 30 is interpolated or extrapolated for the respective bearing mat up to a setpoint pressure $p_s$.

For interpolation or extrapolation of the compression curve 30, the travel x of the punch 28 instead of the pressure p can also be fixed at a constant value $x_0$ for the respective series, wherein during movement of the punch 28 the pressure p again is measured in dependence on the travel x and transmitted to the controller 20.

Figure 4:
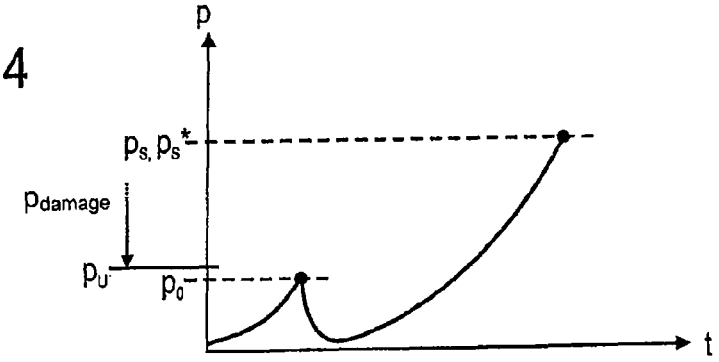
FIG. 4 shows the course of the application of pressure onto the compensating element over time in accordance with one method variant.

FIGS. 3 and 4 show a method variant in which the setpoint pressure $p_s$ lies in a damaging region $p_{damage}$ of the compensating element 12 and the predetermined test limit $p_0$ lies below the damaging region $p_{damage}$, wherein the setpoint deformation $x_s$ for the setpoint pressure $p_s$ is extrapolated from the compression curve 30 plotted up to $x_0$ or $p_0$.

The setpoint deformation $x_s$ can additionally be adapted by a correction value $K_1$, wherein the correction value $K_1$ considers influences of the assembly of the insert in the outer housing 14 on the deformation behavior of the compensating element 12. This correction value $K_1$ is determined empirically for the respectively used assembly method (wrapping, stuffing, . . . ) and subsequently considered in the manufacture of all correspondingly mounted devices 8. The correction value can be used to achieve a target gap, a target pressure, or a target gap bulk density (GBD).

Alternatively or in addition, the correction value $K_1$ can also cover a future rebound of the outer housing 14, a change in shape of the outer housing 14 in the case of changes in temperature, and possibly further parameters.

In the embodiment as shown in FIG. 3, the setpoint pressure $p_s$ (by calculation) is increased by an amount $\Delta p$ by using the correction value $K_1$. In this way, the setpoint pressure $p_s$* to be applied by the outer housing 14 is obtained, which corresponds to a travel $x_s$* of the punch 28. This travel $x_s$* then determines the setpoint deformation $x_s$* of the bearing mat.

Figure 5:
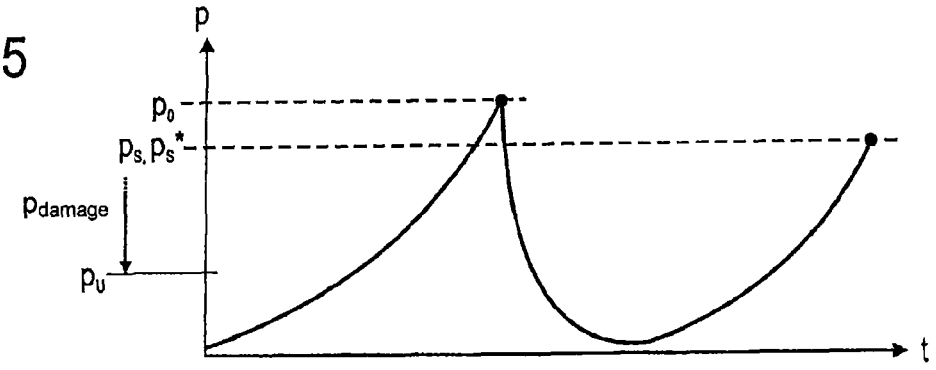
FIG. 5 shows the course of the application of pressure onto the compensating element over time in accordance with an alternative method variant.

As an alternative to FIG. 4, FIG. 5 shows a method variant in which the setpoint pressure $p_s$ and the predetermined test limit $p_0$ lie in a damaging range $p_{damage}$ of the compensating element, wherein the setpoint deformation $x_s$ for the setpoint pressure $p_s$ is interpolated or extrapolated from the compression curve 30 plotted up to $x_0$ or $p_0$, and is additionally adapted by a correction value $K_2$, wherein the correction value $K_2$ considers a damage of the compensating element 12 during the application of pressure up to the predetermined test limit $p_0$.

As shown in FIG. 5, the predetermined test limit $p_0$ even lies above the specified setpoint pressure $p_s$ or $p_s$*, so that the setpoint deformation $x_s$ or $x_s$* can be determined by interpolation.

Exactly as in the method variant of FIG. 4, the correction value $K_1$ can of course also be considered in addition to the correction value $K_2$. In this variant, too, the setpoint pressure $p_s$ represents the clamping pressure between insert and outer housing 14, which is desired in operation of the exhaust gas ducting device 8, whereas the setpoint pressure $p_s$* is a quantity adapted by calculation by using one or more correction values $K_1$, $K_2$.

With the data obtained on the insert to be used (comprising the substrate 10 and the compensating element 12). a geometry of the outer housing 14 adjusted to at least the compressibility of the bearing mat is determined in the controller 20, which can be effected by calculating or by comparing with an allocation matrix stored in the controller 20. The individual geometry is designed to achieve the required clamping force to be exerted and individually adjusted to the insert.

In a next step, this determined outer housing 14 with an adjusted geometry is manufactured for example by incremental forming (see position 29 in FIG. 2). This can be effected by mandrel or roll bending, but the bending roller must be dimensioned very small, in order to be able to produce the necessary small forms.

Figure 6:
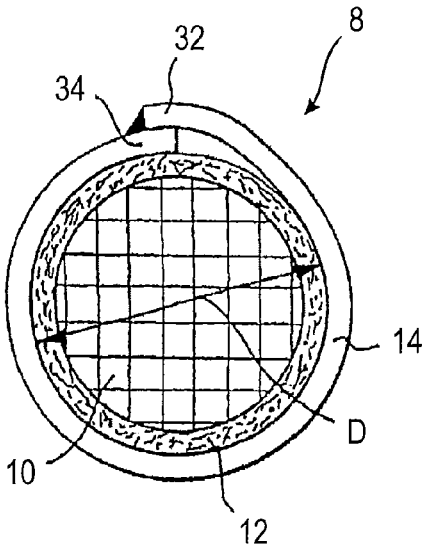
FIG. 6 shows a cross-section through a device manufactured in accordance with the invention, wherein the outer housing is wrapped.

Subsequently, the compensating element 12 is placed around the substrate 10 in the form of the bearing mat and the insert thus obtained is mounted in its tailor-made outer housing 14, wherein the inside dimensions D of the outer housing 14 ultimately correspond to the outside dimensions D of the insert with the determined setpoint deformation $x_s$ or $x_s$*. As shown in FIG. 2, assembly is effected by the so-called "wrapping" method (see position 31). For this purpose, the prefabricated outer housing 14 is slightly expanded and the insert is laterally pushed into the outer housing 14. The outer housing 14 is closed under pressure and/or path control, in that the overlapping edges 32, 34 are pushed over each other to such an extent that the dimensions of the resulting outer housing 14 correspond to the previously determined values. The closing process is effected with reference to suitable parameters previously determined in the controller 20 and adjusted to the individual substrate 10 and/or the bearing mat. Subsequently, the overlapping edges are joined, e.g. welded, folded, soldered or bonded. The finished product is shown in FIG. 6.

The steps during the manufacture of the outer housing, which are represented under positions 29 and 31, merely are shown by way of example. The corresponding steps are different in other assembly methods.

Figure 7:
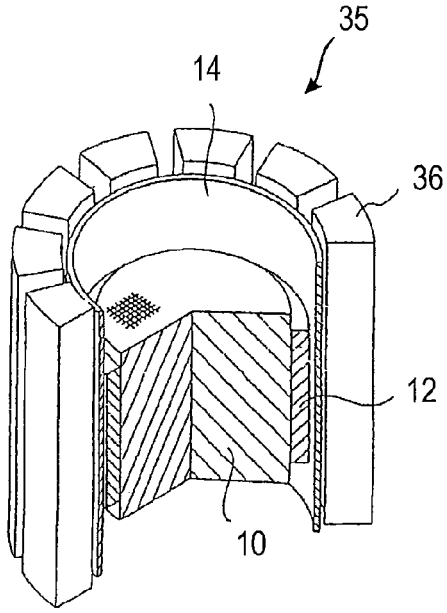
FIG. 7 shows a perspective view of a calibrating tool used in the method of the invention, partly in section.

As an alternative to wrapping of the outer housing 14, assembly can also be effected by so-called "calibration." A corresponding calibrating device 35 is shown in FIG. 7. The same comprises numerous circular-segment-shaped, radially movable jaws 36 which can close to form a ring. In the interior of the working space circumscribed by the jaws 36. the circular-cylindrical, tubular outer housing 14 is placed, into which the insert is pushed axially. The jaws 36 are subsequently moved radially to the inside, wherein in particular the values for the travel $x_s$ or $x_s$* previously stored in the controller 20 can be used. This means that the desired outside dimensions of the insert previously determined by the controller 20 are achieved by a path-controlled movement of the jaws 36 with simultaneous plastic deformation of the outer housing 14. Of course, this requires that before the deformation the insert has been positioned in the outer housing 14 approximately without clearance or the clearance has been considered in the deformation. In the ideal case, the pressure applied onto the insert by the plastically deformed outer housing 14 hence exactly corresponds (upon rebound) to the setpoint pressure $p_s$.

In this manufacturing method the step shown in FIG. 2 is possibly omitted completely; the only preparatory step would be to provide a tube portion with suitable diameter.

Instead of the jaws 36 shown in FIG. 7, calibrating can also be effected by using rollers which are laterally urged against the outer housing 14 with the insert arranged therein by the predetermined travel $x_s$ or $x_s$* and rotated. A so-called "pressing" also is possible in this connection, in which the outer housing 14 with the insert provided therein is relatively moved against an individual roller by the predetermined travel $x_s$ or $x_s$*. and subsequently a relative rotation between the roller and the outer housing 14 including the insert is effected, so that the roller circumferentially is pressed into the outer housing 14, plastically deforming the same to the inside by the travel $x_s$ or $x_s$*.

Figure 8:
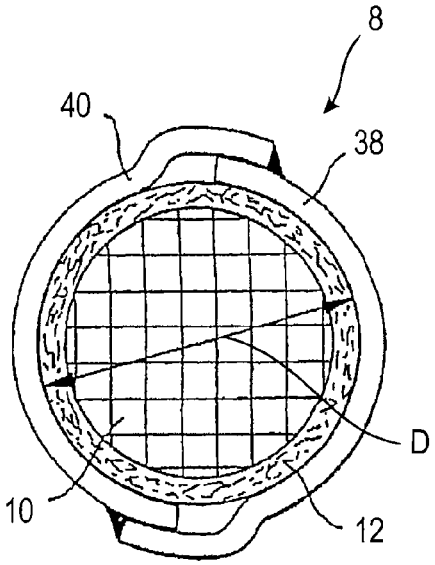
FIG. 8 shows a cross-section through a device manufactured in accordance with the invention, wherein the outer housing is composed of shells.

The embodiment shown in FIG. 8 employs two or more shells 38, 40 which are pushed into each other. Under path control, the shells 38, 40 here are also pushed into each other, until the inside dimension D corresponds to the determined outside dimension D of the insert. The shells 38, 40 then are for example welded together, folded or soldered. Here as well, a rebound or expansion compensation should again be included.

Figure 9:
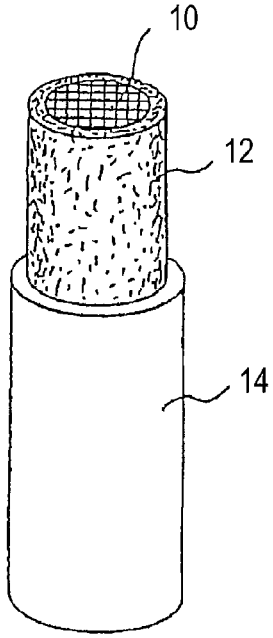
FIG. 9 shows a principal diagram which illustrates the stuffing alternatively employed in the method of the invention.

In FIG. 9, the so-called "stuffing" is indicated schematically. The desired outside dimensions of the insert initially are determined by the controller 20. Subsequently, a cylindrical, tubular outer housing 14 is manufactured with the desired diameter D. Such calibration can be effected in one or more working steps or in a continuous process (e.g. rolling). Subsequently, the insert is axially stuffed into the selected outer housing 14. Corresponding funnel-shaped members or members for radial pre-compression are of course provided. The expansion of the outer housing 14 effected in the stuffing method can be compensated by the correction value $K_1$ analogous to the procedure described for the rebound when determining the setpoint deformation $x_s$*.

The method of the invention offers numerous advantages. Applicability. for example. is also given with substrates 10 of non-round cross-section, such as with oval or so-called "tri-oval" substrate diameters. Under pressure load of the flat compensating element 12 (in contrast to a pressure load of the entire insert) twisting or jamming is not possible. At the same time a quality check of the compensating element 12 is performed. Due to the determination of the substrate geometry a geometric inspection of the substrate 10 is also included in the method. Thus, the additional testing effort can be reduced. By using the described method, the functional parameter pressure can be controlled and an improved process accuracy and repeatability can be achieved. There is obtained an improved quality of the exhaust gas cleaning device manufactured; in particular, the method is suitable for so-called "ultra-thin-wall" substrates.

The method described uses individual compression curves 30, i.e. deformation-pressure curves for each individual exhaust gas ducting device 8, in order to always achieve a desired clamping force of the insert in the outer housing 14 as exactly as possible. The described calculation via a constant setpoint pressure $p_s$, $p_s$* of the compensating element 12 is much more exact than conventional methods which are aimed at a constant gap size or a constant density of the compensating element 12 in the gap between substrate 10 and outer housing 14.

It should be emphasized that the illustrated method is not intended for test purposes, for example, in which an individual catalyst or particle filter is manufactured. Rather, the method is intended especially for mass production, in which each individual bearing mat is exposed to pressure and deformed before installation.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A method for manufacturing exhaust gas ducting devices, in particular exhaust gas cleaning devices, which each have an outer housing with an insert clamped therein, wherein the insert comprises a substrate traversed by exhaust gas, and an elastic compensating element surrounding the substrate, including the following steps:

a) spreading each individual compensating element on a base separately from the substrate and deforming each compensating element substantially vertical to the base by exerting a pressure, wherein the entire compensating element is subjected to a full-surface load, b) determining a setpoint deformation of the compensating element necessary to achieve a specified setpoint pressure based on the pressure and associated deformation from step a), c) determining at least one parameter of the substrate individually, d) placing the compensating element around the substrate subsequent to deforming the compensating element, and e) mounting the insert thus obtained in the outer housing having inside dimensions that correspond to outside dimensions of the insert with the determined setpoint deformation.

2. The method according to claim 1, including constantly increasing the pressure exerted in step a) up to a predetermined test limit.

3. The method according to claim 2, wherein in step a) deformation and pressure values are measured continuously and included in a compression curve of the compensating element.

4. The method according to claim 2, wherein the setpoint pressure lies in a damaging range of the compensating element and the predetermined test limit lies below the damaging range, and wherein step b) includes extrapolating the setpoint deformation from the deformation upon application of pressure up to the predetermined test limit.

5. The method according to claim 4, wherein in step b) the setpoint deformation is extrapolated from the deformation upon application of pressure up to the predetermined test limit and is additionally adapted by a correction value, wherein the correction value considers influences of the assembly in step e) on the deformation behavior of the compensating element.

6. The method according to claim 2, wherein the setpoint pressure and the predetermined test limit lie in a damaging range of the compensating element, wherein in step b) the setpoint deformation is interpolated or extrapolated from the deformation upon application of pressure up to the predetermined test limit and is additionally adapted by a correction value, wherein the correction value considers a damage of the compensating element during the application of pressure up to the predetermined test limit.

7. The method according to claim 6, wherein the setpoint deformation is adapted by the correction value and a subsequent correction value, wherein the subsequent correction value considers influences of the assembly in step e) on the deformation behavior of the compensating element.

8. The method according to claim 4, wherein a lower limit of the damaging range lies at about 33% of the setpoint pressure.

9. The method according to claim 6, wherein during or after the interpolation or extrapolation at least one of the following parameters is considered: rebound of the outer housing, expansion of the outer housing, change in shape of the outer housing with changes in temperature.

10. The method according to claim 1, wherein step c) includes determining the individual outer geometry of the substrate.

11. The method according to claim 10, including measuring the substrate to determine the individual outer geometry.

12. The method according to claim 1, wherein the device includes a ceramic substrate.

13. The method according to claim 1, wherein the device is an exhaust gas catalyst, a particle filter, or a combination thereof.

14. The method according to claim 1, including using a sheet metal housing as the outer housing.

15. The method according to claim 1, including producing the outer housing by wrapping the outer housing around the insert.

16. The method according to claim 1, including pressing the outer housing against the insert by calibrating.

17. The method according to claim 1, wherein the outer housing is comprised of a plurality of shells which are pressed against the insert and attached to each other.

18. The method according to claim 1, including stuffing the insert into a prefabricated cylindrical outer housing having dimensions that correspond to the determined outside dimensions of the insert.

19. The method according to claim 1, wherein with reference to the pressure and associated deformation determined in step a) a 100% incoming goods inspection is performed.

20. The method according to claim 1, wherein the base comprises a flat structure and wherein step a) includes spreading each individual compensating element to lie flat on the base.

21. The method according to claim 20, wherein each individual compensating element includes a lower surface resting on the base and an upper surface facing opposite the lower surface, and including using a punch to apply pressure against the upper surface in a direction vertical to the base to deform the compensating element.

22. A method for manufacturing exhaust gas ducting devices, in particular exhaust gas cleaning devices, which each have an outer housing with an insert clamped therein, wherein the insert comprises a substrate traversed by exhaust gas, and an elastic compensating element surrounding the substrate, including the following steps:

a) spreading each individual compensating element on a base and deforming each compensating element substantially vertical to the base by exerting a pressure, wherein the entire compensating element is subjected to a full-surface load, b) constantly increasing the pressure exerted in step a) up to a predetermined test limit, c) determining a setpoint deformation of the compensating element necessary to achieve a specified setpoint pressure based on the pressure and associated deformation from step a), wherein the setpoint pressure and the predetermined test limit lie in a damaging range of the compensating element, wherein the setpoint deformation is interpolated or extrapolated from the deformation upon application of pressure up to the predetermined test limit and is additionally adapted by a correction value, wherein the correction value considers a damage of the compensating element during the application of pressure up to the predetermined test limit, and wherein the predetermined test limit lies above the specified setpoint pressure, d) determining at least one parameter of the substrate individually, e) placing the compensating element around the substrate, and f) mounting the insert thus obtained in the outer housing having inside dimensions that correspond to outside dimensions of the insert with the determined setpoint deformation.

* * * * *